US005642837A

United States Patent [19]

Hayes et al.

[11] Patent Number: 5,642,837

[45] Date of Patent: Jul. 1, 1997

[54] VITAMIN PACKET DISPENSER UNIT

[75] Inventors: Kim G. Hayes, Salt Lake City; Mark J. Crapo, Sandy, both of Utah

[73] Assignee: Weider Nutrition Group, Inc., Salt Lake City, Utah

[21] Appl. No.: 510,997

[22] Filed: Jun. 30, 1995

[51] Int. Cl.[6] ..... B65H 1/00

[52] U.S. Cl. ..... 221/197; 312/42

[58] Field of Search ..... 221/197, 191, 221/92, 282, 283, 311, 305, 312 R; 206/44.12; 312/35, 42, 119, 122, 126

[56] References Cited

U.S. PATENT DOCUMENTS

| | | | |
|---|---|---|---|
| 1,974,926 | 9/1934 | Marsh | 221/197 |
| 2,299,027 | 10/1942 | Novak | 312/42 |
| 3,450,308 | 6/1969 | Schoenefeld | 221/91 |
| 3,889,867 | 6/1975 | Berg | 229/28 R |
| 3,955,671 | 5/1976 | Ockey | 206/44 R |
| 3,990,752 | 11/1976 | Hoffman | 312/118 |
| 4,592,486 | 6/1986 | Belokin | 221/283 |
| 4,767,022 | 8/1988 | Oldorf | 221/92 |
| 4,787,533 | 11/1988 | Haroutel | 221/12 |
| 4,899,929 | 2/1990 | Grollman | 229/122.1 |
| 5,249,737 | 10/1993 | Fritz et al. | 229/122.1 |
| 5,328,082 | 7/1994 | Fritz et al. | 229/122.1 |
| 5,370,220 | 12/1994 | Wang | 206/44.12 |

*Primary Examiner*—Kenneth Noland
*Attorney, Agent, or Firm*—Eleanor V. Goodall

[57] ABSTRACT

A dispenser unit for dispensing small packets, such as may be used to contain daily dosages of vitamins, comprising an outer holder made of a lightweight rigid material, and one or more inner cartons which are supported by the outer holder. Each inner carton is constructed of cardboard or the like and contains and dispenses packets through an opening at the lower front edge. The carton is sized so that a plurality of packets can be stacked neatly within the container and withdrawn one at a time. The inventive container/dispenser is preferably attached to a refrigerator by a strip of magnetic tape, so that it may be kept at a convenient height and location.

20 Claims, 6 Drawing Sheets

VITAMIN PACKET DISPENSER UNIT

I. BACKGROUND OF THE INVENTION

A. Field of the Invention

This invention relates to an apparatus for dispensing small packets, and in particular for dispensing packets containing daily dosages of vitamins. The invention is particularly designed for home use but could be used in retail or institutions as well.

B. The Background Art

Devices for dispensing various items are known in the prior art. Gravity-fed dispensers, in which the item to be dispensed is moved to the bottom of the dispenser by gravity and withdrawn from an opening at the lower end of the dispenser, are frequently used. Items which are relatively rigid, uniform, and of a shape which can be aligned and stacked in a container can be readily dispensed from gravity-feed dispensers, by allowing the stacked items to rest upon the horizontal bottom of the dispenser and providing an opening on the front of the dispenser at a short distance from the bottom of the container. In order to remove the lowest item from the container, it must be lifted slightly to fit through the opening. The force of gravity thus prevents the items from escaping through the opening. Examples of this type of dispenser, for dispensing cylindrical items and box-shaped items, are shown in Novak (U.S. Pat. No. 2,299,027) and Wang (U.S. Pat. No. 5,370,220), respectively.

It is more difficult to design gravity-feed dispensers for items which are irregularly shaped or not readily stackable. The major challenge is to design an opening which retains the items within the container, but permits a single item to be removed easily when desired. Packets are often simply dispensed from an open-topped container, as in the inventions of Hoffman et al. (U.S. Pat. No. 3,990,752), Berg (U.S. Pat. No. 3,889,867) and Ockey (U.S. Pat. No. 3,955,671). One approach to dispensing irregular or non-stackable items from a gravity-feed dispenser is to provide a drawer at the bottom of the dispenser from which items can be withdrawn when the drawer is opened. See, for example the patents of Fritz et al. (U.S. Pats. No. 5,249,737 and 5,328,082) and Grollman (U.S. Pat. No. 3,889,867). In each of these inventions, the dispensed items are not organized in any particular fashion within the dispenser, and are not presented one at a time.

Oldorf (U.S. Pat. No. 4,767,022) discloses an apparatus for dispensing packets of prescription drugs. An opening at the bottom front of the dispenser permits withdrawal of packets. The size of the opening is apparently small enough that the packets are retained within the dispenser except when withdrawn. A shelf or tray at the lower end of the opening also aids in retaining packets within the dispenser. Since packets are not uniformly aligned within the dispenser, it appears that there is no mechanism to prevent packets from becoming jammed in the opening, or to prevent more than one packet from being withdrawn at a time.

II. BRIEF SUMMARY AND OBJECTS OF THE INVENTION

The invention is a dispenser unit for dispensing small packets containing daily dosages of vitamins. The inventive dispenser unit would be equally well-suited for dispensing small packets containing other items, such as candies, medicines, small toys, samples of cosmetics or toiletries, or powdered or granular materials such as detergent, sugar or salt. Although the dispenser unit is particularly designed for home use, it could be readily used in retail for dispensing samples or small items for sale, or in institutions such as hospitals to dispense packets of medicine, or in cafeterias, to dispense condiments.

The dispenser unit includes an outer holder which is made of a lightweight rigid material and which can be attached to a vertical surface, and which is capable of holding one or more cartons which contain the packets which are to be dispensed. Each carton is constructed of cardboard or the like and contains and dispenses packets of vitamins or other items through an opening at the lower front edge. A single carton may have a divider, thereby forming two compartments, each of which contains vitamin packets. Each carton is sized so that the packets are maintained in a neat stack therein, and can be withdrawn easily, one at a time.

The primary objectives of the present invention are:

1) to contain and dispense packets containing daily dosages of vitamin tablets;
2) to separately contain and dispense two or more different types of vitamin packets. Two or more single cartons, each containing a different type of packet, or a single carton with one or more dividerw which form separate compartments for different types of packets, may be held in the outer holder. This is advantageous if, for example, several types of vitamins are routinely used.
3) to contain a plurality of packets in such a manner that the packets remain neatly stacked within the dispenser and can be easily withdrawn one at a time. The inner carton of the invention is sized to maintain the packets in a neat stack. The sloping bottom of the carton urges the lowermost packet toward the opening and causes it to separate from the packet above it, while the size and shape of the opening holds the lowest packet so that it can readily be withdrawn, but does not fall out of the container. Easy withdrawal of a single packet greatly enhances the convenience and usefulness of the invention.
4) to provide a container/dispenser for packets which can be removably attached to the front or side of a refrigerator, or other vertical surface. The inventive container/dispenser is preferably attached to a refrigerator by means of a strip of magnetic tape. The benefit of attaching the container/dispenser to a vertical surface, and in particular a refrigerator side or door, is that it may be placed at a convenient height, and may be kept in a conventient location without taking up space on (for example) a kitchen counter or table.
5) to provide a packet dispenser unit on which text or designs can be printed. This has the advantage that information may be presented which is relevant to the particular packets being dispensed or which enhances the esthetic qualities of the dispenser.

III. BRIEF DESCRIPTION OF THE DRAWINGS

IV. DETAILED DESCRIPTION OF THE PREFERRED EMBODIMENT

Figure 1:
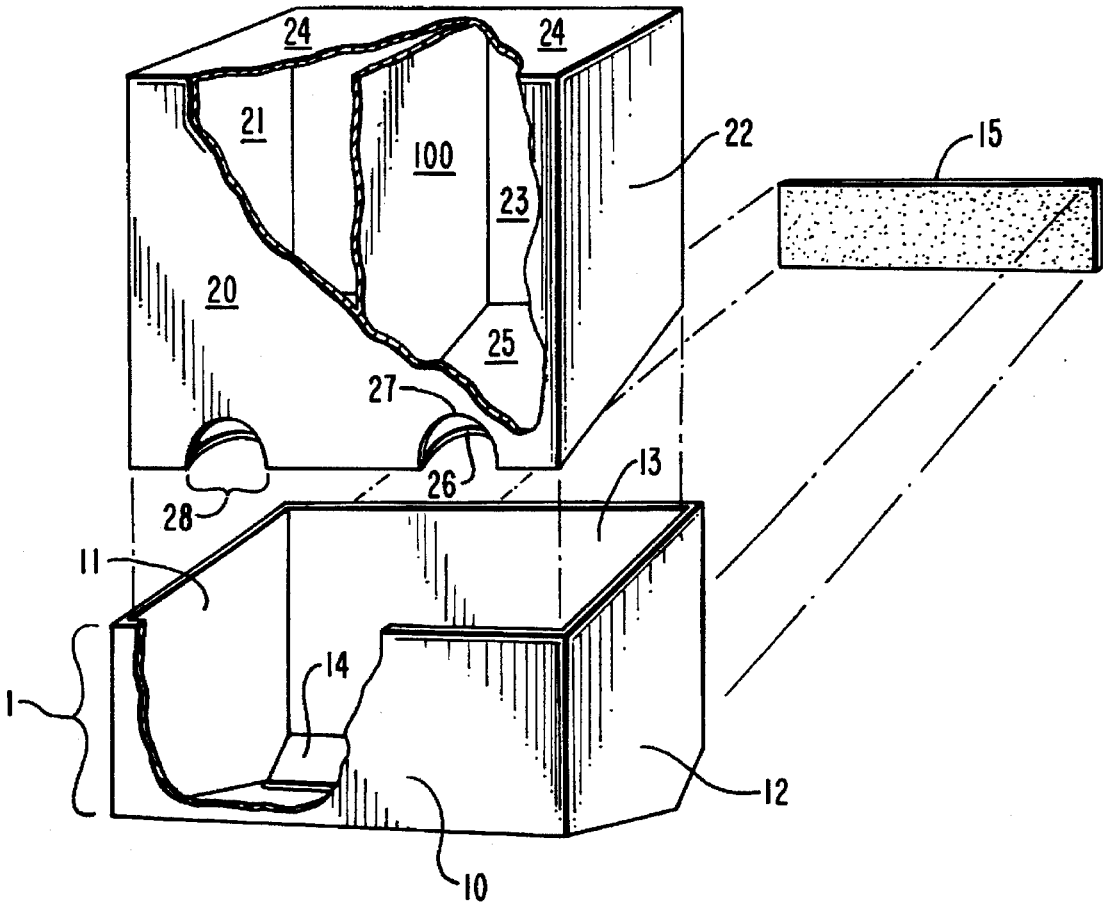
FIG. 1 is an exploded cutaway view of the packet dispenser unit, showing the preferred embodiment of the inner carton.

An example of the preferred embodiment of the invention is shown in FIG. 1. The invention comprises outer holder 1 and, in this embodiment of the invention, an inner carton 2. In the preferred embodiment of the invention, carton 2 has been provided with one or more internal dividers 100. Said internal divider(s) create two or more internal compartments 101 in carton 2, which is thus equivalent to two or more smaller cartons. Inner carton 2 has a sloping bottom panel. In an alternative embodiment of the invention, shown in FIG. 2, two inner cartons, each labelled 2, are used. In this example, the interior of each carton 2 is equivalent to internal compartment 101. Although two cartons are used in the example shown here, any number of cartons can be used, providing that the dimensions of the cartons 2 and outer holder 1 are such that said cartons slide easily into outer holder 1, but fit closely enough that they are held in an upright position. Inner carton 2 is preferably constructed from a lightweight, relatively rigid material, such as cardboard or paperboard. It must be sufficiently stiff to support its own weight and the weight of the packets contained therein. Any other materials with comparable properties, e.g., thin plastic or metal, could also be used, but are less preferred As shown in FIG. 1, Outer holder 1 is constructed with a bottom opening which is sized so that the lower part of carton 2, projects from said bottom opening. Outer holder 1 has four essentially vertical panels: front panel 10, side panels 11 and 12, and back panel 13. Said four essentially vertical panels form a container with a top opening and a bottom opening. Outer holder 1 also has a sloping bottom panel 14, the back edge of which is higher than the front edge. Bottom panel 14 obstructs the back portion of said bottom opening of outer holder 1 so that the inner carton(s) 2 are unable to slide out said bottom opening. Panel 14 is preferably at an angle of about −15 to about −75 degrees relative to horizontal. In the example shown in FIG. 1, panel 14 is at an angle of −43 degrees. Any angle can be used, providing that bottom panel 14 projects far enough into said bottom opening that inner carton 2 is prevented from sliding out of said bottom opening.

In the example shown in FIG. 1, front panel 10 is 6.125" wide and 3.25" tall. Side panels 11 and 12 are 3.25 tall along the front edge, 2.63" tall along the back edge and 2.3125 wide (from front to back). Back panel 13 is 6.125" wide and 2.63" tall. The top edge of back panel 13 is aligned with the top edges of side panels 11 and 12, while the bottom edge is connected to the top edge of bottom panel 14, which angles down and ends with its bottom edge at the same level as the lower edge of side panels 11 and 12. Bottom panel 14 is 0.889" along its short dimension and 6.125" along its long dimension. Outer holder 1 is preferably constructed from about 3/32" thick stiff cardboard. Another preferred material for outer holder 1 is 1/8" thick clear acrylic. Alternatively, outer holder 1 may be constructed from any other lightweight, rigid material which can be readily formed in sheets, for example, various sorts of plastic, metal, or wood. Outer holder 1 may be molded in a single piece or formed by gluing or otherwise connecting separate sheets. In the preferred embodiment of the invention, outer holder 1 is constructed from cardboard panels which are glued together.

In the preferred embodiment of the invention magnetic strip 15 is attached to the outer side of back panel 13, with glue or the like. Magnetic strip 15 is used to attach outer holder 1 to the front or side of a refrigerator or similar metallic surface. Alternately, other means could be used to attach outer holder 1 to a vertical surface. For example, if more permanent attachment was desired, double-sided tape or some other adhesive could be used in place of magnetic strip 15. Various types of brackets or other attachment means are known in the prior art, and could be used in place of magnetic strip 15 to attach outer holder 1 to a vertical surface. It would also be possible to provide a support which would allow the dispenser to be held upright when set on a horizontal surface. This could be accomplished, for example, by extending side panels 11 and 12 downward below the lowest point of inner carton 2 and having horizontal lower edges on these panels so that they would also serve as a means for mounting or supporting outer holder 1 on a horizontal surface.

Inner carton 2 has four essentially vertical panels: front panel 20, side panels 21 and 22, and pack panel 23. It has an essentially horizontal top panel 24, and a sloping bottom panel 25. Bottom panel 25 slopes downward toward the front of the carton. Accordingly, front panel 20 of the carton is taller than back panel 23, and the bottom edges of each of side panels 21 and 22 slope downward toward front panel 20. In the preferred embodiment of invention shown in the FIG. 1, there is a dispensing opening 28 centered on each internal compartment 101. Opening 28 is formed by an arched or semicircular opening 26 at the front edge of bottom panel 25 and a second arched or semicircular opening 27 at the bottom edge of front panel 20. which together form an opening 28 through which a packet can be withdrawn.

Figure 3A:
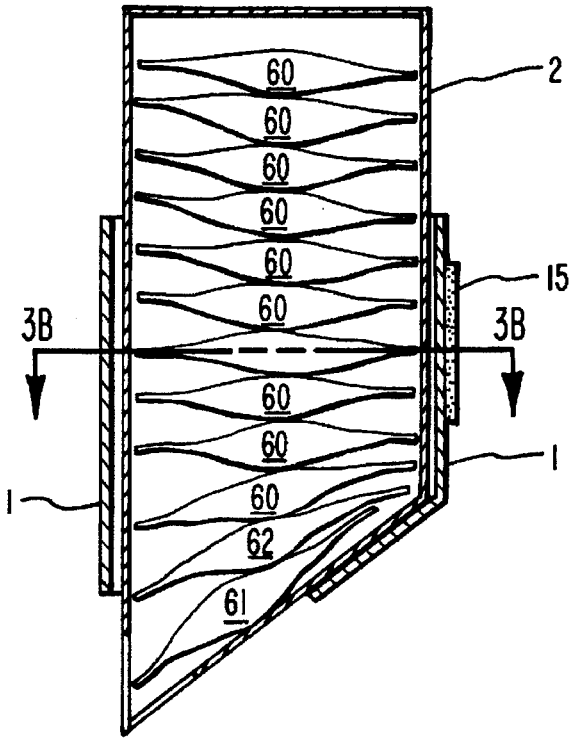
FIG. 3A is a cross-section side view of the packet dispenser.

In the examples of the invention shown in the figures, each inner compartment of the invention will contain about 30 packets, each of which is slightly less than about 3" by 2", and at most about 1/4" thick. The packets will typically be thin at their edges and thicker and somewhat lumpy or irregular in their central portions, depending upon the arrangement of contents within the packet. In the preferred embodiment of the invention, each packet contains about 3 or 4 vitamin tablets or capsules. The packet dimensions must be sufficiently smaller than the inner dimensions of the inner carton that the packet will not stick in said inner carton due to frictional forces. FIG. 3A illustrates the disposition of packets 60 within the packet dispenser unit. The sloping bottom panel 25 of each carton urges the lowermost packets toward the opening. The slope also causes the lowermost packets to fan out, so that the lowest packet 61 makes only limited contact (along the back edge) with packet 62 above it. Therefore, withdrawal of the lowest packet 61 from the dispenser is not impeded by frictional forces, nor is there a tendency for several packets to be withdrawn at the same time because they are held together by frictional forces. The angle of bottom panel 25 is preferably between about −10 and about −85 degrees with respect to horizontal in order to urge the packets toward the opening. It is most preferably between about −25 and about −65 degrees, and even more preferably between about −30 and −60 degrees with respect to horizontal. In the example of the preferred embodiment of the invention shown in the figures, the slope of bottom panel 25 is −43 degrees with respect to horizontal.

Figure 2:
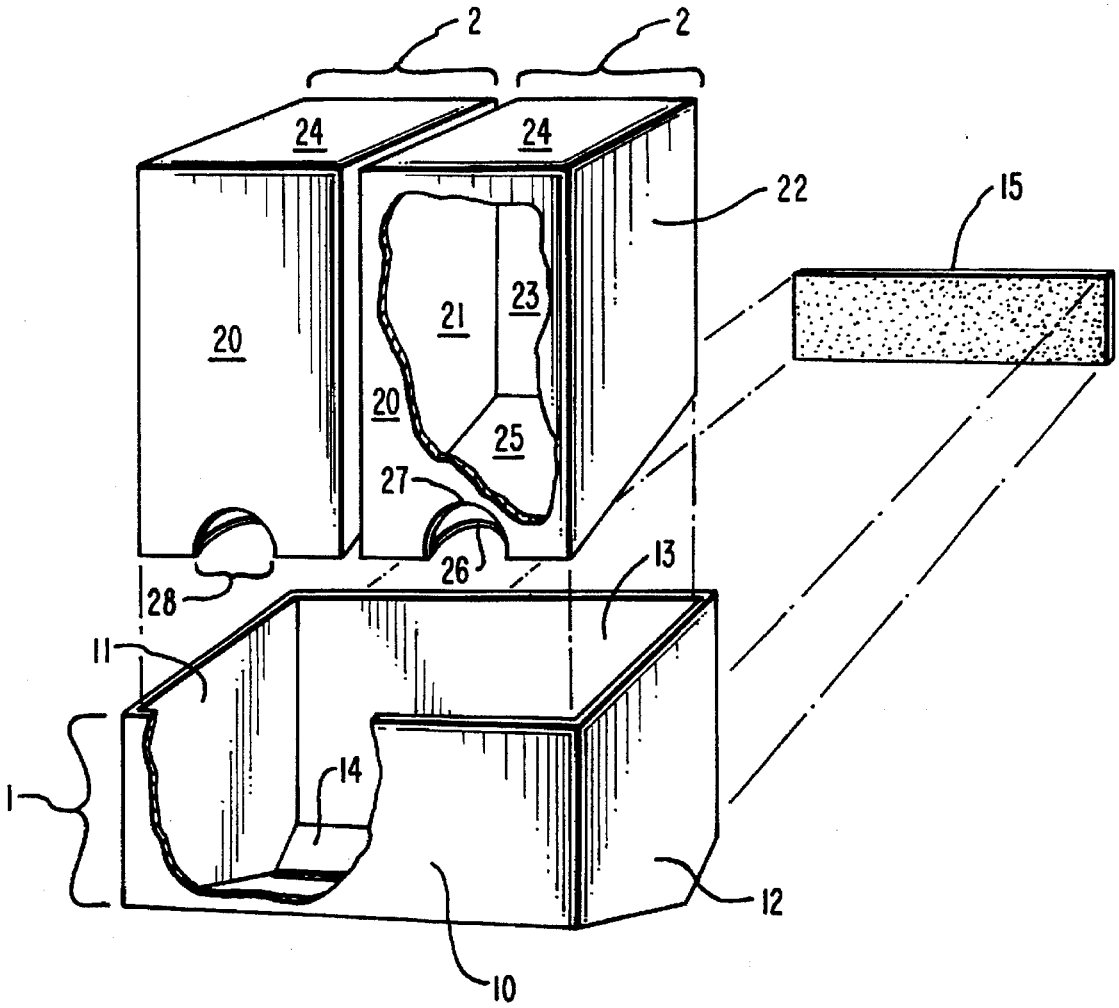
FIG. 2 is an exploded cutaway view of the packet dispenser unit, showing an alternative embodiment of the inner carton.
Figure 3B:
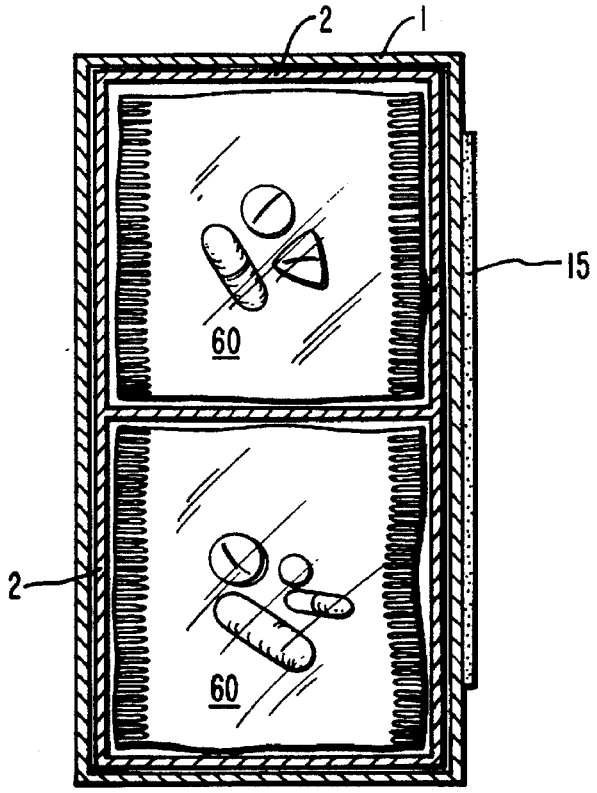
FIG. 3B is a cross-section top view of the packet dispenser (taken at section line B of FIG. 3A).

The dimensions given in the above example are intended only to serve as an illustration. The dimensions of the outer container may be varied as desired. It is necessary that the cross-sectional dimensions of internal compartment 101 be slightly larger than the packet to be contained within the carton, as illustrated in FIG. 3B, which shows a cross-section of FIG. 3A taken at section line B. Similarly, the outer holder 1 must be slightly larger than the carton or cartons which are to be held therein. The size of the inner carton(s) 2 relative to outer holder 1, must be such that carton(s) 2 (one or more) may be slid into outer holder 1 from the top, are held upright within the outer holder, and do not slide out the bottom. A difference of about 0.04" between the width or depth of inner carton 2 and the corresponding inner dimension of outer holder 1 is typically sufficient to allow inner carton 2 to be slid easily into outer holder 1 but to be remain securely therein. Each inner carton 2 is prevented from sliding out of outer holder 1 because it rests upon sloping bottom panel 14. If several cartons are to be held in the outer holder (if, for example, packets of several different sizes are to be dispensed), they do not have to be the same width, but they should be of the same depth. The top portion of carton 2 may extend beyond the top of outer container 1 as shown in FIG. 1, FIG. 2 AND FIG. 3. The height of carton may thus be varied as desired.

Figure 4:
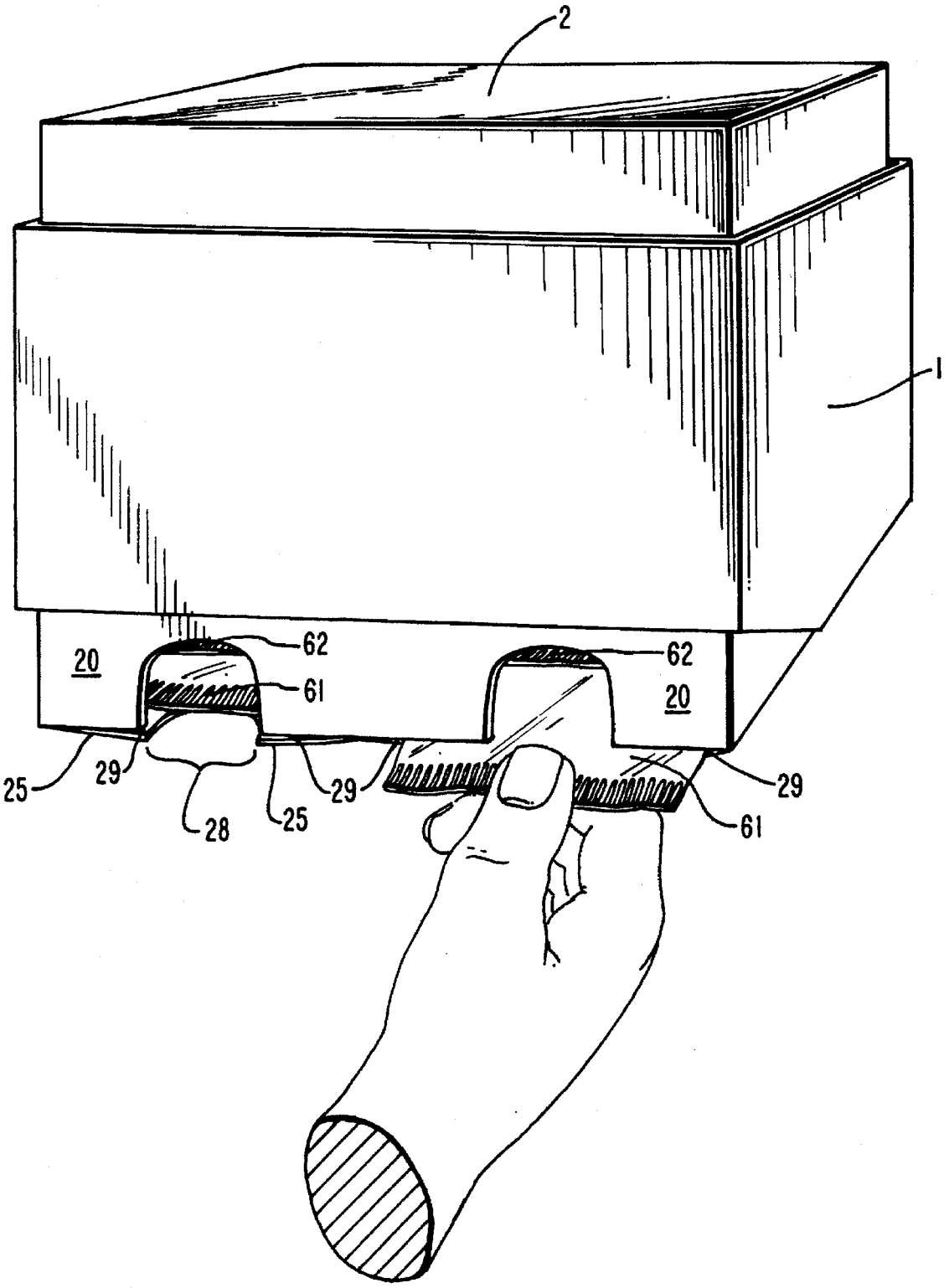
FIG. 4 is a perspective view of the dispenser unit showing withdrawal of a packet from the unit.

As illustrated in FIG. 4, the lowermost packet 61 is presented at opening 28. The packet is removed by first grasping it (preferably between the thumb and forefinger) and then pulling it from the carton. Opening 28 is sufficiently large to allow the packet to be grasped between the thumb and forefinger. However, the packet is not withdrawn only through opening 28: while the thicker center portion of the packet is withdrawn through opening 28, the thin outer edges of the packet are withdrawn through slits 29 between the front edge of bottom panel 25 and the bottom edge of front panel 20, on either side of opening 28.

Figure 5:
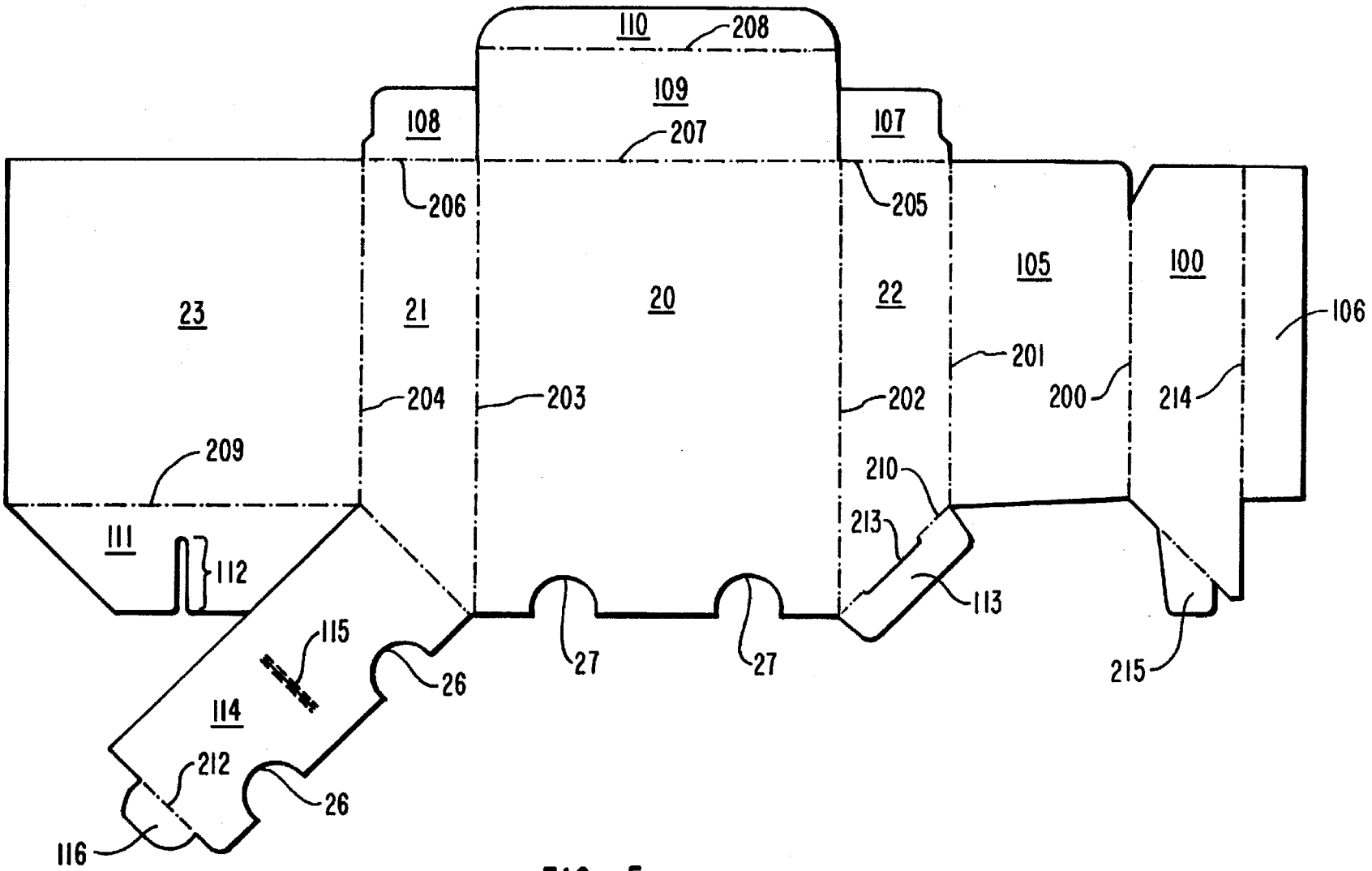
FIG. 5 is a die line drawing of the carton used in the preferred embodiment of the invention.

FIG. 5 is a die drawing for the carton used in the example of the preferred embodiment of the invention shown in FIG. 1. The carton is constructed by folding the flat sheet on lines 201, 202, 203 and 214 to form side panel 22, front panel 20, side panel 21, and back panel 23. Panel 105 lies inside back panel 23 and forms a portion of the back panel. Internal divider 100 is folded inwards along line 200 and flap 106 is folded in along line 214 and glued to front panel 20 to hold internal divider 100 in place. Back panel 23 is glued to panel 105. Flaps 107 and 108 are folded downward along lined 205 and 206, respectively, and panel 109 is folded downward along line 207. Flap 110 is folded downward along line 208 and inserted in the slot formed by the back edges of flaps 107 and 108 and the top edge of back panel 23. Panel 109, together with flaps 107 and 108, forms top panel 24 of the carton. Panel 111 is folded up along line 209, flap 113 is folded up along line 210, and panel 114 is folded up along line 215. Tab 116 is folded in along line 212 and inserted into slot 213 to hold panel 114 in place. Panels 111 and 114 together form bottom panel 25. Tab 215 on internal divider 100 fits into slots 112 and 115 to hold internal divider 100 in position with respect to bottom panel 25. Semicircular openings 27 which are contiguous with the lower edge of front panel 20 cooperate with semicircular openings 26 at the front of the bottom panel to form an opening 28 in the assembled carton.

Figure 6:
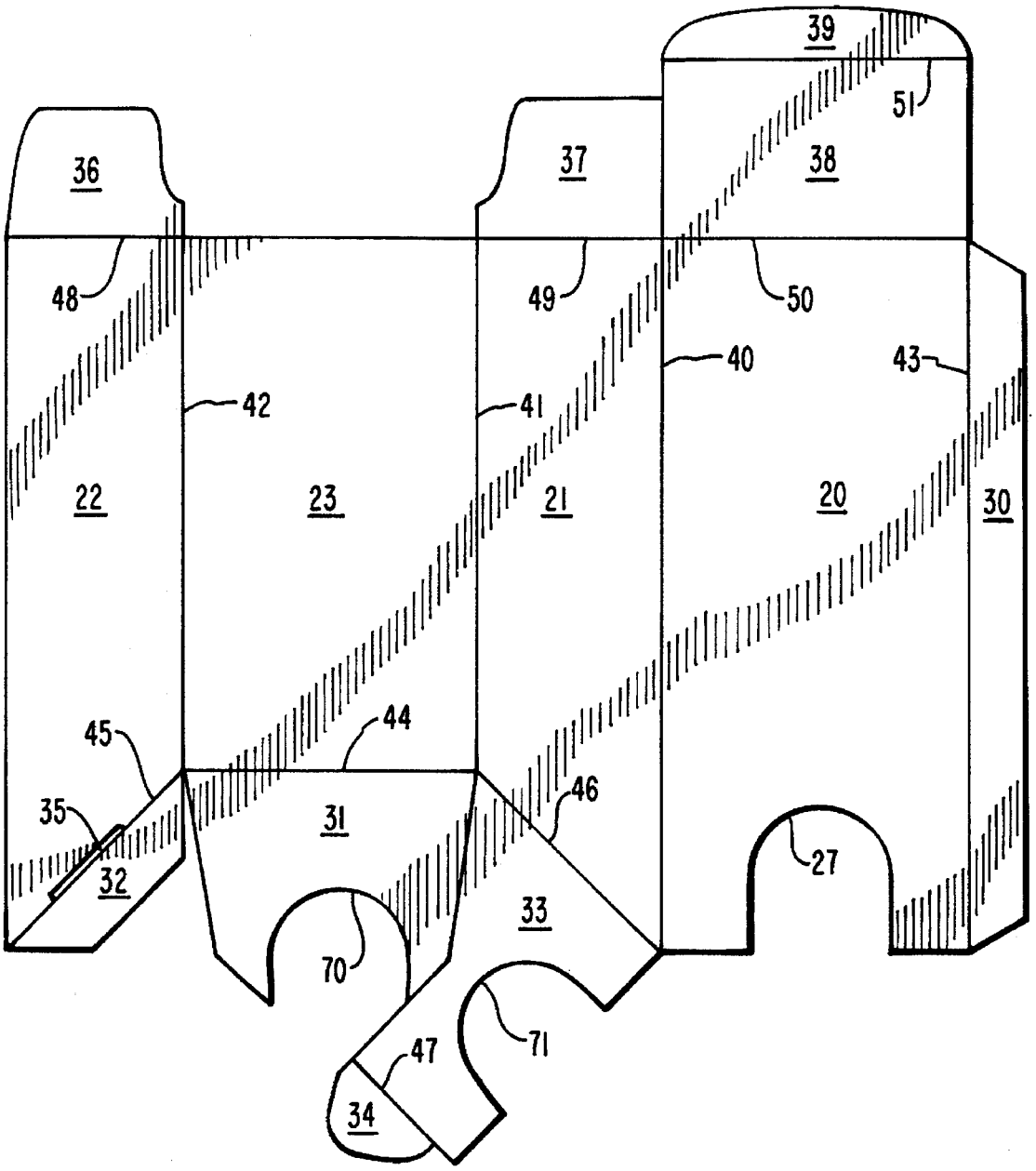
FIG. 6 is a die line drawing of the carton used in and alternative embodiment of the invention.

FIG. 6 is a die drawing for the carton used in the example of the alternative embodiment of the invention shown in FIG. 2. The carton is constructed by folding the flat sheet on lines 40, 41 and 42 to form front panel 20, side panels 21 and 22, and back panel 23, respectively. Flap 30 is folded in along line 43 and glued to side panel 22. Bottom panel 25 is then formed by folding flap 31 in along line 44, flap 32 in along line 45, flap 33 in along line 46, and finally folding tab 34 in along 0line 47 and inserting said tab into slot 35. Semicircular opening 70 in flap 31 and semicircular opening 71 in flap 33, which overlap when the carton is assembled, together form semicircular opening 26 which is contiguous with the front edge of the bottom panel of the carton. Semicircular opening 27 which is contiguous with the lower edge of front panel 20 cooperates with semicircular opening 26 at the front of the bottom panel to form an opening 28. Top panel 24 is constructed by folding flap 37 down along line 49, folding flap 38 down along line 50, folding tab 39 down along line 51, and inserting it into the slit between back panel 23 and the back edges of flaps 37 and 37. Various other die-cut layouts may be contemplated which can be assembled into a carton 2 having the configuration shown herein, and these are also considered to fall within the scope of the present invention.

In one embodiment of the invention, outer holder 1 is constructed from acrylic. In addition to being light and rigid, acrylic has the advantage of being transparent. This means that any illustration or text printed on carton(s) 2 held by the outer holder 1 will be visible through the front and side panels of the outer holder. For example, it may be desirable for the carton to indicate the contents of the packets (e.g., vitamins) and/or provide instructions for their use. Alternatively, the carton may be printed with an advertising design or slogan, or simply with a decorative pattern, depending on the intended use of the packet dispenser unit. The advantage of having text, illustrations, etc. printed on the inner carton rather than the outer holder is that when one or more of the inner cartons are changed, the text is changed appropriately without the need to replace the outer holder as well. In the preferred embodiment of the invention, in which outer holder 1 is constructed of stiff cardboard, various text or illustrations can be printed directly upon the cardboard.

The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. An apparatus for containing and dispensing packets, comprising:

a) at least one inner carton;

b) an outer holder; and c) a mounting device for mounting said outer holder in an upright position;

wherein each said at least one inner carton is sized to hold a plurality of flat packets in stacked and aligned relationship; wherein the bottom panel of said inner carton slopes downward toward at least one dispensing opening at the lower front edge of said inner carton; wherein said dispensing opening comprises s slit at the lower front edge of said inner carton and an arched cutout communicating with said slit, through which a packet presented at said dispensing opening can be grasped and withdrawn; wherein said outer holder is sized to contain said at least one inner carton securely in an upright position; and wherein said packets may be withdrawn one at a time from the bottom of the stack within said inner carton through said dispensing opening.

2. An apparatus as in claim 1, wherein said inner carton is constructed of cardboard.

3. An apparatus as in claim 1, wherein said mounting device comprises a magnet.

4. An apparatus as in claim 1, wherein said outer holder is constructed of a lightweight, rigid material.

5. An apparatus as in claim 4, wherein said outer holder is constructed of stiff cardboard.

6. An apparatus as in claim 4, wherein said outer holder is constructed of transparent acrylic.

7. An apparatus as in claim 6, wherein a pattern is printed on said inner carton and wherein said pattern is visible through said outer holder.

8. A packet dispensing system comprising:

a) at least one inner carton, said inner carton comprising a front panel, a back panel, two side panels, and a sloping bottom panel, wherein the front edge of said bottom panel is lower than the back edge of said bottom panel, wherein said dispensing inner carton has an opening at its lower front portion, wherein a plurality of packets are contained within said inner carton and wherein said packets can be withdrawn one at a time from said inner carton through said dispensing opening;

b) an outer holder comprising a front panel, a back panel, and two side panels, which together form a container with an top opening and a bottom opening, and a sloping bottom panel, wherein the front edge of said bottom panel is lower than the back edge of said bottom panel, wherein the back edge of said bottom panel is attached to the bottom edge of said back panel, and wherein said bottom panel covers only the rear portion of said bottom opening; and c) a fastener affixed to the back panel of said outer holder, said fastener adapted for fastening said outer holder removably to a vertical surface;

wherein said outer holder is slightly larger than said at least one inner carton so that said at least one inner carton can be removably inserted into said outer holder and held securely upright therein, wherein said bottom panel prevents said at least one inner carton from slipping out of said bottom opening, and wherein said lower front portion of said inner carton projects from said bottom opening of said outer holder, whereby said dispensing opening is accessible.

9. A packet dispensing system as in claim 8, wherein said inner carton is constructed of cardboard.

10. A packet dispensing system as in claim 8, wherein said mounting device comprises a magnet.

11. A packet dispensing system as in claim 8, wherein said outer holder is constructed of a lightweight, rigid material.

12. A packet dispensing system as in claim 11, wherein said outer holder is constructed of stiff cardboard.

13. A packet dispensing system as in claim 11, wherein said outer holder is constructed of transparent acrylic.

14. A packet dispensing system as in claim 13, wherein a pattern is printed on said inner carton and wherein said pattern is visible through said outer holder.

15. A packet dispensing system comprising:

a) at least one inner carton, said inner carton comprising a front panel, a back panel, two side panels, a sloping bottom panel, and at least one vertical internal divider positioned parallel to said side panels, wherein the front edge of said bottom panel is lower than the back edge of said bottom panel, wherein said at least one internal divider divides said inner carton into at least two internal compartments, wherein said inner carton has a multiplicity of dispensing openings at its lower front portion, each of said openings corresponding to and centered on one of said internal compartments, wherein a plurality of packets are contained within each said internal compartment and wherein said packets can be withdrawn one at a time from said internal compartment through said dispensing openings;

b) an outer holder comprising a front panel, a back panel, and two side panels, which together form a container with an top opening and a bottom opening, and a sloping bottom panel, wherein the front edge of said bottom panel is lower than the back edge of said bottom panel, wherein the back edge of said bottom panel is attached to the bottom edge of said back panel, and wherein said bottom panel covers only the rear portion of said bottom opening; and c) a fastener affixed to the back panel of said outer holder, said fastener adapted for fastening said outer holder removably to a vertical surface;

wherein said outer holder is slightly larger than said at least one inner carton so that said inner carton can be removably inserted into said outer holder and held securely upright therein, wherein said bottom panel prevents said at least one inner carton from slipping out of said bottom opening, and wherein said lower front portion of said inner carton projects from said bottom opening of said outer holder, whereby said dispensing opening is accessible.

16. A packet dispensing system as in claim 15, wherein said at least one inner carton is constructed of cardboard.

17. A packet dispensing system as in claim 15, wherein said mounting device comprises a magnet.

18. A packet dispensing system as in claim 15, wherein a pattern is printed on the front panel of said outer carton and on the portion of the front panel of said inner carton that projects above the top edge of said outer carton.

19. A packet dispensing system as in claim 15, wherein said outer holder is constructed of a lightweight, rigid material.

20. A packet dispensing system as in claim 19, wherein said outer holder is constructed of stiff cardboard.

* * * * *